US006398973B1

(12) United States Patent
Saunders et al.

(10) Patent No.: US 6,398,973 B1
(45) Date of Patent: Jun. 4, 2002

(54) CYCLONE SEPARATOR

(75) Inventors: David Henry Saunders, Bucks; Emil Gyorgy Arato, Bedford; Owen Matthew Davies, Milton Keynes, all of (GB)

(73) Assignee: B.H.R. Group Limited (GB)

( * ) Notice: Subject to any disclaimer, the term of this patent is extended or adjusted under 35 U.S.C. 154(b) by 0 days.

(21) Appl. No.: 09/530,846

(22) PCT Filed: Nov. 4, 1998

(86) PCT No.: PCT/GB98/03306

§ 371 Date: Jul. 12, 2000

(87) PCT Pub. No.: WO99/22873

PCT Pub. Date: May 14, 1999

(30) Foreign Application Priority Data

Nov. 4, 1997 (GB) ..... 9723345
Aug. 5, 1998 (GB) ..... 9817073

(51) Int. Cl.[7] ..... A47L 9/16; B04C 3/00

(52) U.S. Cl. ..... 210/788; 210/512.1; 209/710; 209/717; 209/721; 209/722; 209/723; 209/728; 209/732; 209/734; 55/459.1; 55/459.3; 55/459.5

(58) Field of Search ..... 210/512.1, 788; 55/459.1, 459.3, 459.5; 209/710, 717, 721, 722, 723, 728, 732, 734

(56) References Cited

U.S. PATENT DOCUMENTS

| | | | | |
|---|---|---|---|---|
| 22,334 A | | 12/1858 | Stern | |
| 2,698,672 A | | 1/1955 | Burnside et al. | |
| 2,837,172 A | | 6/1958 | Klein | |
| 3,481,118 A | | 12/1969 | Willis | |
| 4,246,013 A | | 1/1981 | Truhan et al. | |
| 4,251,241 A | | 2/1981 | Bothun | |
| 4,305,825 A | | 12/1981 | Laval, Jr. | |
| 4,334,986 A | | 6/1982 | Frykhult | |
| 4,378,234 A | * | 3/1983 | Suzuki et al. | 55/459.3 |
| 4,581,050 A | | 4/1986 | Krantz | |
| 4,643,748 A | | 2/1987 | Dyson | |
| 5,062,870 A | | 11/1991 | Dyson | |
| 5,078,761 A | | 1/1992 | Dyson | |
| 5,080,697 A | | 1/1992 | Finke | |
| 5,090,976 A | | 2/1992 | Dyson | |
| 5,135,552 A | | 8/1992 | Weistra | |
| 5,137,554 A | | 8/1992 | Carter, Jr. | |
| 5,160,356 A | | 11/1992 | Dyson | |
| 5,558,697 A | | 9/1996 | Dyson et al. | |
| 5,965,021 A | * | 10/1999 | Hesse et al. | 210/512.1 |

FOREIGN PATENT DOCUMENTS

| | | |
|---|---|---|
| DE | 39 36 078 | 2/1976 |
| DE | 2946572 | 5/1981 |
| DE | 39 36 078 A1 * | 10/1989 |
| EP | 042723 | 12/1981 |

(List continued on next page.)

*Primary Examiner*—David A. Reifsnyder
(74) *Attorney, Agent, or Firm*—Blakely Sokoloff Taylor & Zafman

(57) ABSTRACT

A cyclone separator has an inlet chamber 52 and an outlet chamber 53, means 51 for introducing a fluid mixture into the inlet chamber so that it swirls around the chamber and passes to the outlet chamber in which it swirls about an outlet chamber axis, the outlet chamber being provided with means 62 for conducting heavier phase fluids from the outlet chamber at a relatively large distance from the outlet chamber axis and an outlet 63 for lighter phase fluids at a relatively small distance from the outlet chamber axis 55. The flow through the separator and the efficiency of separation are improved by forming at least one of the chambers 52, 53 as involute shaped, the corresponding one 51, 62 of said means being defined by the curved wall of the involute of maximum radius.

14 Claims, 2 Drawing Sheets

FOREIGN PATENT DOCUMENTS

Figure 1:
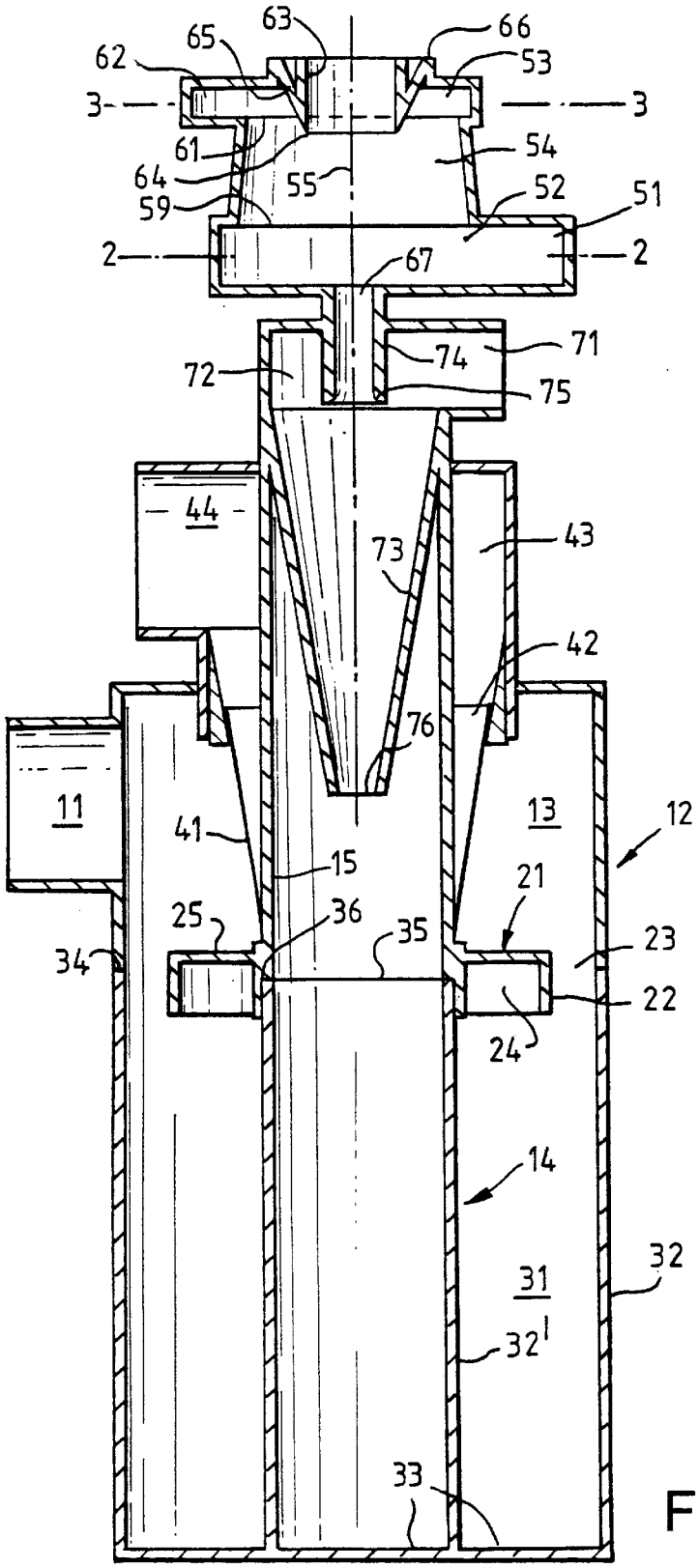

| | | | |
|---|---|---|---|
| EP | 430647 | | 6/1991 |
| EP | 489565 | | 6/1992 |
| EP | 626338 | | 2/1995 |
| FR | 2174912 | | 10/1973 |
| GB | 2137906 | | 2/1938 |
| GB | 2271728 | | 4/1994 |
| GB | 2132511 | | 7/1994 |
| GB | 2296452 | | 3/1995 |
| GB | 2295311 | | 5/1996 |
| GB | 2296206 | | 6/1996 |
| GB | 2296879 | | 7/1996 |
| GB | 2297243 | | 7/1996 |
| RU | 2034513 | | 5/1995 |
| SE | 465949 | | 11/1991 |
| SU | 1764625 | | 9/1990 |
| SU | 1805908 | | 3/1993 |
| WO | WO93/09875 | | 3/1993 |
| WO | WO95/10972 | | 4/1995 |
| WO | WO 95/25584 | * | 9/1995 |
| WO | WO9619294 | | 6/1996 |
| WO | WO9709122 | | 3/1997 |

* cited by examiner

CYCLONE SEPARATOR

This invention relates to the separation of fluid phases, for example the separation of particulate matter from gases such as air.

Standard cyclone separators cause the incoming fluid mixture to swirl around a chamber so that phases separate radially due to the accelerations towards the axis, the separated phases being removed through separate outlets at different radii. Besides the chamber in which separation takes place, an inlet chamber may be provided in which linear motion of the fluid mixture is converted into swirling motion. This has normally been arranged by making the inlet chamber a cylinder with a linear inlet conduit entering the periphery of the cylinder along a tangent, so that the fluid from the inlet conduit then swirls about the cylinder axis.

The change from linear motion to motion around the inside of the cylinder involves an abrupt change of curvature of the path from zero to the curvature of the cylinder, which may cause turbulence in the flow. We have found a construction of separator in which the change is less abrupt, so that a free vortex is more likely to be found. Continuing increases of curvature enable the flow to be concentrated.

According to the invention there is provided a cyclone separator having an inlet chamber and an outlet chamber, means for introducing a fluid mixture into the inlet chamber so that it swirls around the chamber and passes to the outlet chamber in which it swirls about an outlet chamber axis, the outlet chamber being provided with means for conducting heavier phase fluids from the outlet chamber at a relatively large distance from the outlet chamber axis and an outlet for lighter phase fluids at a relatively small distance from the outlet chamber axis, at least one of the chambers being involute shaped, the corresponding one of said means being defined by the curved wall of the involute of maximum radius.

The involute shaped chamber is preferably the inlet chamber, although making both inlet and outlet chambers involute shaped is also an option. In this case the involutes preferably have a common axis and are arranged so that fluids flowing through them continue to swirl in the same sense about the axis. When he outlet chamber is involute shaped it is preferably that the near-axis outlet comprises a duct extending into the involute chamber (by say 25% of the chamber axial length) to form a vortex finder.

The involute shaped chamber preferably has a curved wall formed from at least three (and preferably four) arcuate portions of uniform curvature, each portion having a smaller curvature than the preceding inner portion, the adjacent portions having their centres on the common normal to the adjacent ends of those portions. An involute may have a maximum radius between 25% and 300% larger than the minimum radius.

An intermediate chamber may be provided between said means of the inlet chamber and of the outlet chamber through which the fluid can swirl in passing from the inlet chamber to the outlet chamber. It may be frusto-conical, preferably with an outlet radius at least half the inlet radius, and preferably with a length less than five times its inlet end diameter and more preferably less than its inlet end diameter.

We have found that an additional inlet in the upstream axial region of an involute chamber can be very useful. This is because the swirl imparted to the incoming mixture causes a low pressure in this axial region; the low pressure can therefore be used to draw in another fluid. The arrangement is very different from a jet pump, which normally has a low pressure inlet entering an axial chamber from one side and a high pressure inlet on the axis. In that case it is the axial high pressure inlet which causes a fluid to be drawn in from the side inlet. There is no effort made to induce swirl in such a jet pump.

When the additional inlet is so provided, it should preferably be of a radius not greater than 50% (and more preferably not greater than 25%) of the minimum radius of the inlet involute and smaller than any outlet on the axis of the outlet involute. Means can be provided for conducting some of the fluid from said means of the outlet chamber to this additional inlet arranged on the axis of swirl of fluid introduced by said means of the inlet chamber. This conducting means preferably includes a further separating stage for fluids from said means of the outlet chamber, the outlet from said further stage for lighter phases being conducted in use to said additional inlet. By passing through the further stage only some rather than all of the full flow through the second stage, it is possible to use a further stage of much smaller volume. The conducting means is preferably arranged to conduct all the fluid from said means of the outlet chamber to said further stage. The further stage could be a separator similar to those already described, or a conventional separator or even just a filter.

The driving force for moving the fluid through the third stage is provided by the low pressure existing at the additional inlet and so no additional energy is required; the driving force for moving the phase mixture through the separator as a whole may be in the form of a fan to draw the less dense fluid out of the separator. This has the advantage that the fan only has to deal with the lighter phases, whereas heavier phases might clog or damage it. Alternatively a pump may be provided to receive the fluid mixture before separation with its outlet connected to the fluid introducing means. A fan could be located between stages.

An example of the invention will now be described with reference to the accompanying drawings in which:

FIG. 1 is a diagram of a three-stage phase separator, and

Figure 2:
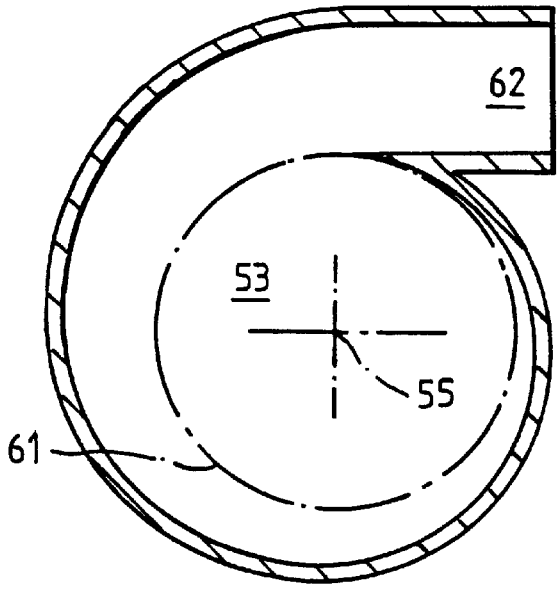
Figure 3:
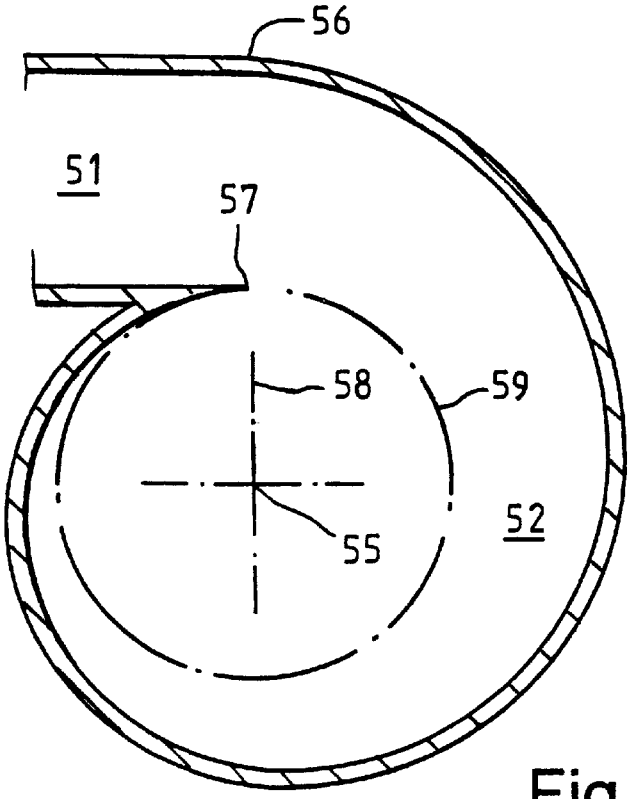

FIGS. 2 and 3 are transverse sections on respective lines 2 and 3.

In an embodiment of the invention, the fluid mixture to be separated into phases is introduced into the apparatus illustrated in FIG. 1 by a tangential conduit 11 leading to a cylindrical separation chamber 13 at the top of a cylindrical container 12. Within the container is a coaxial inner cylinder 14 extending through the full height of the container 12.

The separation chamber 13 is defined at its lower end by a baffle 21 extending outwards from the inner cylinder to a peripheral wall 22 which baffle defines with the wall of the container 12 an annular gap 23 whose (radial) width is slightly less than the (axial) length of the peripheral wall. In this particular example the width is just under 75% of the length. The baffle 21 is undercut at its lower side 24, but presents a continuous upper plane surface 25 and the wall 22 is a continuous outer cylindrical surface. Possible variations of the baffle are described in the simultaneously filed international application WO 99/22874, which is incorporated herein by reference. Furthermore, features from the statements of invention in the simultaneously filed international application based on GB 9723342.3 and 9817074.9 may be combined with the separator of the present invention.

Below the baffle 21 the container 12 defines with the inner cylinder 14 an annular collection chamber 31 to which the only access in the assembled state of the apparatus is through the gap 23. The apparatus can be disassembled by removing the lower portions 32, 32' of the two cylinders which are formed as a single unit joined by a common base 33. The cylindrical container 12 splits at a level 34 just below the top of the baffle and the inner cylinder splits at a slightly lower level 35, still within the length of the baffle, and its upper end fits within a recess,36 in the upper part 15 of the inner cylinder 14 within the baffle. The split in the cylindrical container is shown as a butt join, but some means of making the join more fluid-tight may be provided. A bayonet fitting may be provided to join the cylinders at their split planes; external clamps are another suitable joining means. Annular closed cell foam seals (not shown) may be provided to make the joins fluid-tight.

Above the baffle 21 the central cylinder is surrounded by a frusto conical perforated shroud 41, tapering outwardly towards the top of the container 12 and defining the inner boundary of the separation chamber. The volume between the shroud and the inner cylinder provides an outlet duct 42 which continues to taper outwardly above the shroud and then becomes cylindrical at 43.

The apparatus so far described forms the first stage of the separator. Fluid mixture flowing in the tangential conduit 11 is caused to swirl around the separation chamber 13 as it enters that chamber, the lighter phases tending to move to the smaller radii and heavier phases to the greater radii where they will diffuse and fall under gravity through the gap 23 to the collection chamber 31. As discussed in the co-pending application, the proportions and dimensions of the gap 23 are chosen so that sufficient heavier phase fluid passes through the gap and very little of the heavier phase fluid in the collection chamber 31 is drawn back through the gap. The provision of one or more annular co-axial baffles (not shown) on the base 33 assist the retention of heavier phases against re-entrainment. The lighter phases remaining in the separation chamber 13 pass through the shroud 41 and continue to swirl around the upper part 15 of the central cylinder 14 in the outlet duct 42, 43. This first stage of the separator is an initial stage, in which efficiency is not of prime importance. In a vacuum cleaner application, it serves to remove the fluff and heavier dirt particles from the flow. The shape of the separation chamber and the relationship of its inlet are not critical. The critical separation occurs in the later stages to those described below and it is these stages which embody the essential features of the invention.

The cylindrical part 43 of the outlet duct 42 of the first stage has a tangential outlet 44 leading by means not shown to the inlet conduit 51 of a second stage which has involute shaped inlet and outlet chambers 52, 53 with an intermediate chamber 54 which joins the inlet and outlet chambers along the common axis 55 of the three chambers. As can be seen from FIG. 2, the curved wall of the inlet chamber decreases from a maximum radius at 56 to a minimum radius at 57 as it subtends the full 360 degrees around the axis 55. The downstream end of the inlet conduit 51 is defined on the outside 56 by the curved wall of maximum radius and on the inside 57 by the curved wall of minimum radius. For ease of manufacture, the radius decreases gradually, the curved wall having at least three, and in this embodiment four, sections of constant radius and subtending equal angles (90 degrees) at their respective centres, adjacent sections being centred about points on the common normal to the adjacent ends of those portions (thus making those common ends tangential), the radii of successive sections increasing from the minimum to the maximum. In this embodiment, the innermost section of the involute is centred on the normal 58 which passes through the axis 55. The radius of the inlet end 59 of the intermediate chamber 54 is not greater than the minimum radius of the inlet involute and in this embodiment is smaller than the smallest of the four radii.

The intermediate chamber 54 is frusto-conical, tapering inwardly to a smaller radius at its outlet end 61 which is not greater than and in this embodiment is smaller than the minimum radius of the outlet involute. The radius of the intermediate chamber 54 is of course smaller than the minimum radius of the inlet involute. The curved wall of the outlet involute gradually increases in radius in subtending the full 360 degrees leading to an outlet conduit 62 for heavier phases in the opposite manner to that described for the inlet involute, the involutes being arranged to receive fluids swirling in the same sense about the stage axis 55 as the swirl induced in the inlet involute. There is an axial outlet from the second stage comprising a co-axial inner cylinder 63 extending through the outlet chamber and protruding at 64 slightly into the intermediate chamber 54. A frusto-conical wall 65 surrounds the inner cylinder, tapering outwards from the entry of the axial outlet to the far end 66 of the outlet involute. The inlet involute chamber 52 has an axial inlet 67 of radius small compared to all the radii of the chambers, in this example being one quarter of the minimum radius of the inlet involute.

The fluid mixture flowing in the inlet conduit 51 of the second stage follows the increasing curvature of the curved wall of the inlet involute and so swirls around the axis 55 with increasing velocity. As the swirling mixture travels along the axis 55, the heavier phases tend to move to the outer radii and the lighter phases tend to move towards the axis of the stage. The velocity of swirl is increased by the small entry radius of the intermediate chamber and further by its taper. The lighter phases near the axis will therefore leave the intermediate chamber through the axial outlet cylinder 63, whereas those phases at greater radii will be urged by the tapered shield 65 into the outlet involute around the curved wall of which they will swirl towards the outlet conduit 62. The swirling fluids in the inlet involute will create a low pressure point therein on the axis 55, so that fluids presented at the axial inlet 67 will tend to be drawn into this stage of the separator to move along the stage axis, as will be. described later.

The outlet conduit 62 of the second stage is connected by means not shown to an inlet conduit 71 which is tangential to the cylindrical inlet chamber 72 of a third stage, which is itself of a conventional form. The inlet chamber opens on one side into a co-axial frusto-conical chamber 73 which tapers from a maximum radius equal to that of the inlet chamber 72 to a minimum at the other end where there is an axial outlet 76 for heavier phases, located within the upper part 15 of the inner cylinder of the first stage at a level within the shroud 41. A cylindrical duct 74 coaxial with the inlet chamber 72 has a mouth at the one side of the inlet chamber formed with a radiused inner rim 75 and extends therefrom through that chamber 72 to connect with the axial inlet 67 of the second stage, the axes of the three stages being in this embodiment coincident at 55 and vertical, the outlet 76 of the frusto-conical chamber 73 being at the lowest point of the third stage.

Fluid mixture flowing in the inlet conduit 71 of the third stage is caused to swirl around the chamber 72 as it is deflected around its curved wall, thus providing further separation of the phases. The lighter phases tend to move towards the axis 55 where they reverse axial direction and enter the inner cylinder 74 and are drawn back into the axial inlet 67 of the second stage by the reduced pressure on the axis of the inlet chamber 52 of that second stage, thus being re-subjected to the separation processes of the second and third stages. The flow which is recirculated from outlet 62 back through the inlet 73 is about 5 to 30% of the flow which exits through the outlet 63. By recirculating this fraction, it is possible to form the third stage much smaller in volume than if the third stage had to deal with the whole flow through the second stage. The location of the inner cylinder 74 within the inlet chamber 72 provides a vortex finder as this third stage of the separator. The heavier phases in the chamber 72 tend to move to greater radii within the frusto conical chamber 73 as they continue to swirl, moving down the tapering wall towards the lower end of that chamber to leave by the outlet 76 at the lower end, to continue to the base 33 of the inner cylinder 14 of the first stage.

Heavier phases from the first and third stages therefore collect at the base 33 of the first stage container, those from the first stage within the annular chamber 31 and those from the third stage within the chamber within cylinder 32'. Both these chambers can be emptied by splitting the container as described above. Since there is only a small overlap between the portions of the container 12 across the split, the removal can be effected easily without knocking the upper portion which knocking might cause heavier phases such as dust to be dislodged, falling when the lower portion is no longer in place to collect them.

In the embodiments of the invention so far described, the apparatus is a vacuum cleaner and the mixture of fluid phases comprises dust particles entrained in air. Other mixtures which could be separated include silt entrained in a liquid or a mixture of oil and water. Gases, liquids or solids of different density, or any combinations thereof, or gas that is dissolved in liquid can be supplied to the inlet chamber.

What is claimed is:

1. A cyclone separator including:

an involute-shaped inlet chamber;

an involute-shaped outlet chamber;

a fluid inlet comprising a curved wall of the inlet chamber of maximum radius, for introducing a fluid mixture into the inlet chamber so that it swirls around an inlet chamber axis and passes to the outlet chamber in which it swirls about an outlet chamber axis, the outlet chamber being provided with a light phase outlet for conducting lighter phase fluids;

wherein:

the outlet chamber is also provided with a heavy phase outlet, comprising a curved wall of the outlet chamber of maximum radius, for conducting heavier phase fluids from the outlet chamber, the heavy phase outlet being provided at a relatively large distance from the outlet chamber axis and light phase outlet being provided at a relatively small distance from the outlet chamber axis;

and:

the inlet chamber and the outlet chamber are spaced apart and an intermediate chamber is provided therebetween through which fluid swirls in use in passing from the inlet chamber to the outlet chamber.

2. A separator as claimed in claim 1 wherein the inlet chamber and the outlet chamber are mounted along a common axis and are arranged so that fluids flowing through them continue to swirl in a same sense about the common axis.

3. A separator as claimed in claim 1 or 2 wherein at least one of the involute-shaped inlet chamber and the involute-shaped outlet chamber comprises a curved wall formed from at least three accurate portions of uniform curvature, the adjacent portions having their centres on a common normal to adjacent ends of those portions.

4. A separator as claimed in claim 3 comprising four said portions.

5. A separator as claimed in claim 1 comprising a conducting device for conducting some fluid from the heavy phase outlet of the outlet chamber to an additional inlet arranged on an axis of swirl of fluid introduced by the fluid inlet of the inlet chamber.

6. A separator as claimed in claim 5 wherein said conducting device comprises a further separating stage for fluids from said conducting device, an outlet from said further separating stage being conducted in use to said additional inlet.

7. A separator as claimed in claim 6 wherein said conducting device is arranged to conduct all fluid from said heavy phase outlet of the outlet chamber to said further separating stage.

8. A separator as claimed in claim 5 wherein the fluid inlet and said additional inlet of the inlet chamber are located at opposite ends of a body, comprising the inlet chamber, the intermediate chamber and the outlet chamber, to said heavy and light phase outlets of the outlet chamber.

9. A separator as claimed in claim 5 wherein said additional inlet is of a radius not greater than 50% of a minimum radius of the inlet chamber.

10. A separator as claimed in claim 9, wherein said additional inlet is of a radius smaller than said light phase inlet of the outlet chamber.

11. A separator as claimed in claim 1, wherein the intermediate chamber tapers inwardly from the inlet chamber to the outlet chamber.

12. A separator as claimed in claim 1, wherein the light phase outlet of the outlet chamber comprises a duct extending into the outlet chamber, so as to form a vortex finder.

13. A vacuum cleaner comprising a cyclone separator, the cyclone separator comprising:

an involute-shaped inlet chamber;

an involute-shaped outlet chamber;

a fluid inlet comprising a curved wall of the inlet chamber of maximum radius, for introducing a fluid mixture into the inlet chamber so that it swirls around an inlet chamber axis and passes to the outlet chamber in which it swirls about an outlet chamber axis, the outlet chamber being provided with a light phase outlet for conducting lighter phase fluids;

wherein:

the outlet chamber is also provided with a heavy phase outlet, comprising a curved wall of the outlet chamber of maximum radius, for conducting heavier phase fluids from the outlet chamber, the heavy phase outlet being provided at a relatively large distance from the outlet chamber axis and light phase outlet being provided at a relatively small distance from the outlet chamber axis;

and:

the inlet chamber and the outlet chamber are spaced apart and an intermediate chamber is provided therebetween through which fluid swirls kin use in passing from the inlet chamber to the outlet chamber.

14. A method of separating gases, liquids or solids of different density, or combinations thereof, comprising introducing them as a swirling mixture to the cyclone separator, the cyclone separator comprising:

an involute-shaped inlet chamber;

an involute-shaped outlet chamber;

a fluid inlet comprising a curved wall of the inlet chamber of maximum radius, for introducing a fluid mixture into the inlet chamber so that it swirls around an inlet chamber axis and passes to the outlet chamber in which it swirls about an outlet chamber axis, the outlet chamber being provided with a light phase outlet for conducting lighter phase fluids;

wherein:

the outlet chamber is also provided with a heavy phase outlet, comprising a curved wall of the outlet chamber of maximum radius, for conducting heavier phase fluids from the outlet chamber, the heavy phase outlet being provided at a relatively large distance from the outlet chamber axis and light phrase outlet being provided at a relatively small distance from the outlet chamber axis;

and:

the inlet chamber and the outlet chamber are spaced apart and an intermediate chamber is provided therebetween through which fluid swirls in use in passing from the inlet chamber to the outlet chamber.

* * * * *